US011053836B1

(12) United States Patent
Nackers et al.

(10) Patent No.: US 11,053,836 B1
(45) Date of Patent: Jul. 6, 2021

(54) MARINE DRIVES HAVING INTEGRATED EXHAUST AND STEERING FLUID COOLING APPARATUS

(71) Applicant: Brunswick Corporation, Mettawa, IL (US)

(72) Inventors: Tyler J. Nackers, Oshkosh, WI (US); Premnath Natarajan, Sun Prairie, WI (US); Douglas D. Reichardt, West Bend, WI (US); Mark J. Glodowski, Appleton, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 16/729,855

(22) Filed: Dec. 30, 2019

(51) Int. Cl.

| | |
|---|---|
| ***B63H 20/28*** | (2006.01) |
| ***F01P 3/20*** | (2006.01) |
| ***B63H 20/24*** | (2006.01) |
| ***F02B 61/04*** | (2006.01) |
| *B63H 20/12* | (2006.01) |

(52) U.S. Cl.
CPC ..... *F01P 3/202* (2013.01); *B63H 20/245* (2013.01); *B63H 20/28* (2013.01); *F02B 61/045* (2013.01); *B63H 20/12* (2013.01)

(58) Field of Classification Search
CPC ..... F01P 3/202; F02B 61/045; B63H 20/245; B63H 20/28; B63H 20/12
See application file for complete search history.

(56) References Cited

U.S. PATENT DOCUMENTS

| | | | |
|---|---|---|---|
| 4,066,057 | A | 1/1978 | Hale |
| 4,082,068 | A | 4/1978 | Hale |
| 4,184,462 | A | 1/1980 | Hale |
| 4,689,025 | A | 8/1987 | Ferguson |
| 4,817,566 | A | 4/1989 | Newman |
| 4,932,367 | A | 6/1990 | Newman et al. |
| 5,074,193 | A | 12/1991 | Hundertmark |
| 5,241,894 | A | 9/1993 | Hundertmark |
| 5,392,690 | A | 2/1995 | Hundertmark |
| 6,402,577 | B1 | 6/2002 | Treinen et al. |
| 6,821,168 | B1 | 11/2004 | Fisher et al. |
| 7,150,664 | B1 | 12/2006 | Uppgard et al. |

(Continued)

FOREIGN PATENT DOCUMENTS

| | | |
|---|---|---|
| JP | 2004060557 | 2/2004 |

OTHER PUBLICATIONS

Unpublished U.S. Appl. No. 16/171,490, filed Oct. 26, 2018.

*Primary Examiner* — Stephen P Avila

(57) ABSTRACT

A marine drive is for propelling a marine vessel. The marine drive includes: an engine; an exhaust manifold that conveys exhaust gas from the engine; a cooling jacket on the exhaust manifold, wherein a cooling passage is defined between the cooling jacket and the exhaust manifold; a cooling pump that pumps cooling fluid through the cooling passage so as to cool the exhaust manifold and the exhaust gas; a power steering actuator configured to steer the marine drive relative to the marine vessel; a power steering pump that pumps power steering fluid from a power steering reservoir to the power steering actuator; and a power steering cooler on the exhaust manifold and configured such that the power steering fluid is cooled by the cooling fluid in the cooling passage. In some examples the marine drive is configured for use in an outboard motor.

20 Claims, 11 Drawing Sheets

(56) References Cited

U.S. PATENT DOCUMENTS

| | | | | |
|---|---|---|---|---|
| 7,255,616 | B1 | 8/2007 | Caldwell | |
| 7,267,588 | B1 | 9/2007 | Griffiths et al. | |
| 7,311,571 | B1 | 12/2007 | Swan et al. | |
| 7,398,745 | B1 | 7/2008 | White et al. | |
| 7,585,196 | B1 * | 9/2009 | Jaeger | F01P 3/207 440/88 C |
| 7,699,674 | B1 | 4/2010 | Wald et al. | |
| 3,046,122 | A1 | 10/2011 | Barta et al. | |
| 8,113,892 | B1 | 2/2012 | Gable et al. | |
| 8,298,026 | B2 | 10/2012 | Ochiai | |
| 8,801,482 | B2 | 8/2014 | Ochiai et al. | |
| 8,858,283 | B2 | 10/2014 | Ochiai et al. | |
| 8,899,029 | B1 * | 12/2014 | Dreyer | B63H 21/32 60/321 |
| 8,978,372 | B2 | 3/2015 | Ochiai et al. | |
| 9,120,549 | B2 | 9/2015 | Ochiai et al. | |
| 9,254,905 | B1 * | 2/2016 | Randolph | F04D 13/021 |
| 9,290,256 | B1 | 3/2016 | Wireman et al. | |
| 9,403,588 | B1 | 8/2016 | George et al. | |
| 9,616,987 | B1 | 4/2017 | Langenfeld et al. | |
| 9,745,037 | B2 | 8/2017 | Nakayama et al. | |
| 9,849,957 | B1 | 12/2017 | Grahl et al. | |
| 10,174,661 | B1 * | 1/2019 | Saltsman | F01N 13/10 |
| 10,233,818 | B1 | 3/2019 | Reichardt et al. | |
| 10,378,423 | B1 | 8/2019 | Reichardt et al. | |
| 10,472,038 | B1 | 11/2019 | Walgren et al. | |
| 2013/0066711 | A1 | 3/2013 | Liyanage et al. | |
| 2013/0130577 | A1 | 5/2013 | Ochiai et al. | |
| 2017/0284058 | A1 * | 10/2017 | Soejima | E02F 9/0866 |
| 2018/0022209 | A1 * | 1/2018 | Shiheiber | F01P 3/18 165/288 |

* cited by examiner

| CYLINDER | DISTANCE TO O2 SENSOR (IN TERMS OF DISTANCE BETWEEN CYLINDERS) | DISTANCE TO MIXING ZONE (IN TERMS OF DISTANCE BETWEEN CYLINDERS) |
|---|---|---|
| 1 | 0 | 3 |
| 2 | 1 | 3 |
| 3 | 1 | 4 |
| 4 | 0 | 2 |
| 5 | 2 | 5 |
| 6 | 1 | 3 |
| 7 | 3 | 6 |
| 8 | 2 | 4 |

| CYLINDER | FIRING ORDER -1 | TIME OF EX GAS AT SAME BANK O2 SENSOR | SENSOR LOCATION |
|---|---|---|---|
| 1 | 0 | 0 | STBD |
| 2 | 1 | 2 | PORT |
| 7 | 2 | 5 | STBD |
| 3 | 3 | 4 | STBD |
| 4 | 4 | 4 | PORT |
| 5 | 5 | 7 | STBD |
| 6 | 6 | 7 | PORT |
| 8 | 7 | 9 | PORT |

*FIG. 16*

| CYLINDER | FIRING ORDER -1 | TIME OF EX GAS AT MIXING ZONE |
|---|---|---|
| 1 | 0 | 3 |
| 2 | 1 | 4 |
| 7 | 2 | 8 |
| 3 | 3 | 7 |
| 4 | 4 | 6 |
| 5 | 5 | 10 |
| 6 | 6 | 9 |
| 8 | 7 | 11 |

*FIG. 17*

MARINE DRIVES HAVING INTEGRATED EXHAUST AND STEERING FLUID COOLING APPARATUS

FIELD

The present disclosure relates to marine drives, for example outboard motors, and in particular to exhaust systems for marine drives, as well as to steering and cooling systems for marine drives.

BACKGROUND

The following U.S. patents are incorporated herein by reference in entirety:

U.S. patent application Ser. No. 16/171,490 discloses an outboard motor having a powerhead that causes rotation of a driveshaft, a steering housing located below the powerhead, wherein the driveshaft extends from the powerhead into the steering housing; and a lower gearcase located below the steering housing and supporting a propeller shaft that is coupled to the driveshaft so that rotation of the driveshaft causes rotation of the propeller shaft. The lower gearcase is steerable about a steering axis with respect to the steering housing and powerhead.

U.S. Pat. No. 10,472,038 discloses an outboard motor for propelling a marine vessel in water. The outboard motor can be trimmed about a trim axis into and between a raised position in which the outboard motor is fully trimmed up out of the water and a lowered position in which the outboard motor is fully trimmed down into the water. The outboard motor has a hydraulic steering actuator for steering the outboard motor about steering axis and a reservoir mounted on the outboard motor and containing power steering fluid for the hydraulic steering actuator. A vent opening vents the reservoir to atmosphere and is located on top of the reservoir and closer to the back of the outboard motor than the front of the outboard motor so that the vent opening does not become covered by the power steering fluid when the outboard motor is trimmed into and out of the raised and lowered positions.

U.S. Pat. No. 10,378,423 discloses an exhaust manifold for an outboard motor having an internal combustion engine. The exhaust manifold has an exhaust conduit that conveys exhaust gas from the internal combustion, and a cooling jacket on the exhaust conduit. The cooling jacket defines a first cooling water passage that conveys cooling water in a first direction alongside the exhaust conduit, a second cooling water passage that conveys the cooling water from the first cooling water passage in an opposite, second direction alongside the exhaust conduit, and third cooling water passage that is separate from the first and second cooling water passages and conveys spent cooling water from the internal combustion engine to a thermostat.

U.S. Pat. No. 10,233,818 discloses a marine propulsion device including an internal combustion engine; an axially elongated exhaust conduit that conveys exhaust gas from the upstream internal combustion engine to a downstream outlet; a cooling water sprayer that is configured to spray a flow of cooling water radially outwardly toward an inner diameter of the axially elongated exhaust conduit; a temperature sensor located downstream of the cooling water sprayer and configured to sense temperature of the exhaust gas and cooling water; and a controller configured to identify a fault condition associated with the cooling water sprayer based on the temperature of the exhaust gas and cooling water.

U.S. Pat. No. 9,849,957 discloses a steering actuator for steering an outboard marine engine about a steering axis. The steering actuator comprises a housing; a piston device that is disposed in the housing, wherein hydraulic actuation of the piston device causes the outboard marine engine to pivot about the steering axis; and a valve device that is disposed in the housing. The valve device controls a flow of a power steering fluid to move the piston device in a first piston direction and to move the piston device in an opposite, second piston direction. Movement of the piston device in the first piston direction causes the outboard marine engine to pivot in a first pivot direction and movement of the piston device in the second piston direction causes the outboard marine engine to pivot in an opposite, second pivot direction.

U.S. Pat. No. 9,616,987 discloses a marine engine with a cylinder block having first and second banks of cylinders that are disposed along a longitudinal axis and extend transversely with respect to each other in a V-shape so as to define a valley there between. A catalyst receptacle is disposed at least partially in the valley and contains at least one catalyst that treats exhaust gas from the marine engine. A conduit conveys the exhaust gas from the marine engine to the catalyst receptacle. The conduit receives the exhaust gas from the first and second banks of cylinders and conveys the exhaust gas to the catalyst receptacle. The conduit reverses direction only once with respect to the longitudinal axis.

U.S. Pat. No. 9,403,588 discloses systems for cooling a marine engine that is operated in a body of water. The systems can include an open loop cooling circuit for cooling the marine engine, wherein the open loop cooling circuit is configured to convey cooling water from the body of water to the marine engine so that heat is exchanged between the cooling water and the marine engine, and a pump that is configured to pump the cooling water from upstream to downstream through the open loop cooling circuit. A heat exchanger is configured to cause an exchange of heat between the cooling water located upstream of the marine engine and the cooling water located downstream of the marine engine to thereby warm the cooling water located upstream of the marine engine, prior to cooling the marine engine.

U.S. Pat. No. 9,290,256 discloses a steering system for a trolling motor having a mechanical steering system with a mechanical steering input device and a mechanical linkage extending from the mechanical steering input device to a steering shaft of the trolling motor. Movement of the mechanical steering input device causes movement of the mechanical linkage, which in turn causes rotation of the steering shaft. An electromechanical actuation system is provided that is configured to be coupled to the mechanical steering system. A controller is in signal communication with the electromechanical actuation system and provides steering signals thereto. The electromechanical actuation system selectively actuates the mechanical steering system so as to rotate the steering shaft according to the steering signals provided by the controller. A method for steering a trolling motor is also provided.

U.S. Pat. No. 9,120,549 discloses an engine having a cylinder block including a plurality of cylinders disposed along a V-shaped line, a pair of exhaust manifolds disposed inside the V-shaped line, and an exhaust pipe disposed inside the V-shaped line. Each of the pair of exhaust manifolds includes a first passage that includes a plurality of inflow ports into which exhaust gases from the cylinders flow, a collecting portion at which exhaust gases are collected, and an exhaust port from which exhaust gases are discharged. The exhaust pipe includes a connection passage that includes a pair of intermediate inflow ports that are connected to the exhaust ports, at least one intermediate exhaust port from which exhaust gases are discharged. The connection passage is arranged to connect the pair of intermediate inflow ports and the at least one intermediate exhaust port.

U.S. Pat. No. 8,978,372 discloses a V-type engine having two exhaust manifolds connected to two cylinder banks. First and second exhaust ports, respectively provided in the two cylinder banks, are disposed at an inner side of V-shaped lines. Each exhaust manifold includes N branch pipes and a collecting pipe, where N is an integer not less than two. The N branch pipes are respectively connected to N exhaust ports including at least one of the first exhaust ports and at least one of the second exhaust ports. The collecting pipe is disposed adjacent to N cylinders that are aligned in a direction parallel or substantially parallel to a crank axis direction and extends from one end to the other end of the N cylinders.

U.S. Pat. No. 7,398,745 discloses a cooling system for a marine propulsion device having a bypass loop around a cooling pump that allows the flow of cooling water through certain components to be reduced or increased as a function of the temperature of those components while causing a full flow of cooling water to flow through other selected heat emitting devices. Using this configuration of components and bypass conduits, the operating condition of the cooling water pump can be continually monitored, including the condition of its flexible vanes. By observing the effective cooling capacity of the system under conditions with the bypass valve open and closed, the effectiveness of the cooling water pump can be assessed and a suggestion of maintenance can be provided.

U.S. Pat. No. 6,402,577 discloses a hydraulic steering system in which a steering actuator is an integral portion of the support structure of a marine propulsion system. A steering arm is contained completely within the support structure of the marine propulsion system and disposed about its steering axis. An extension of the steering arm extends into a sliding joint which has a linear component and a rotational component which allow the extension of the steering arm to move relative to a moveable second portion of the steering actuator. The moveable second portion of the steering actuator moves linearly within a cylinder cavity formed in a first portion of the steering actuator.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

In certain examples disclosed herein, a marine drive includes: an engine; an exhaust manifold that conveys exhaust gas from the engine; a cooling jacket on the exhaust manifold, wherein a cooling passage is defined between the cooling jacket and the exhaust manifold; a cooling pump that pumps cooling fluid through the cooling passage so as to cool the exhaust manifold and the exhaust gas; a power steering actuator configured to steer the marine drive relative to the marine vessel; a power steering pump that pumps power steering fluid from a power steering reservoir to the power steering actuator; and a power steering cooler on the exhaust manifold and configured such that the power steering fluid is cooled by the cooling fluid in the cooling passage. In certain examples the marine drive is configured for use in an outboard motor.

In certain examples disclosed herein, a marine engine includes a cylinder block having first and second banks of cylinders disposed along a longitudinal axis and extending transversely relative to each other in a V-shape so as to define a valley there between, and first and second exhaust logs in which exhaust gases from the first and second banks of cylinders are collected and conveyed. An exhaust manifold is located in the V-shape and configured to merge and convey the exhaust gases from the first and second exhaust logs. The exhaust manifold has a first inlet port that receives substantially all said exhaust gas from the first exhaust log and a second inlet port that receives substantially all said exhaust gas from the second exhaust log. The first and second inlet ports are longitudinally offset relative to each other.

In certain examples disclosed herein, an exhaust manifold is for marine engine having a cylinder block having first and second banks of cylinders disposed along a longitudinal axis and extending transversely relative to each other in a V-shape so as to define a valley there between, and first and second exhaust logs in which exhaust gases from the first and second banks of cylinders are collected and conveyed. The exhaust manifold includes an exhaust manifold configured to merge said exhaust gases from the first and second exhaust logs and to convey said exhaust gases, wherein the exhaust manifold has a first inlet port that receives substantially all said exhaust gas from the first exhaust log and a second inlet port that receives substantially all said exhaust gas from the second exhaust log, and wherein the first and second inlet ports are longitudinally offset relative to each other.

In certain examples disclosed herein, a method is for making an exhaust manifold for a marine engine having first and second banks of cylinders disposed along a longitudinal axis and extending transversely relative to each other in a V-shape. The method comprises forming the exhaust manifold with a first inlet port for receiving substantially all said exhaust gas from the first exhaust log, a second exhaust port for receiving substantially all said exhaust gas from the second exhaust log, and a mixing zone in which the exhaust gas from the first exhaust log mixes with the exhaust gas from the second exhaust log; locating the first and second inlet ports at a nonzero longitudinal offset distance relative to each other; and selecting the nonzero longitudinal offset distance so that the exhaust gas from the first exhaust log does not arrive in the in the mixing zone simultaneously with the exhaust gas from the second exhaust log, thereby avoiding stuffing of the exhaust gas.

In certain examples disclosed herein, a method is for making an exhaust manifold for a marine engine having first and second banks of cylinders disposed along a longitudinal axis and extending transversely relative to each other in a V-shape. The method comprises forming the exhaust manifold with a first inlet port for receiving substantially all said exhaust gas from the first exhaust log, a second exhaust port for receiving substantially all said exhaust gas from the second exhaust log, and a mixing zone in which the exhaust gas from the first exhaust log mixes with the exhaust gas from the second exhaust log; locating the first and second inlet ports at a nonzero longitudinal offset distance relative to each other; forming the exhaust manifold with a first inlet passage conveying the exhaust gas from the first inlet port and a second inlet passage conveying exhaust gas from the second inlet port; installing a first exhaust sensor in the first exhaust log, the first exhaust sensor configured to sense a characteristic of the exhaust gas in the first inlet passage; installing a second exhaust sensor in the second exhaust log, the second exhaust sensor configured to sense a characteristic of the exhaust gas in the second inlet passage; and selecting the nonzero longitudinal offset distance so that the exhaust gas from each cylinder in the respective first and second banks of cylinders does not simultaneously arrive at the first and second exhaust sensors, respectively.

BRIEF DESCRIPTION OF THE DRAWINGS

Reference is made to the following drawing figures. The same numbers are used throughout to reference like features and components.

FIG. 5 is a rear perspective view of the marine drive, particularly showing the power steering cooler and flow of power steering fluid there through.

FIG. 16 is a table showing firing order, estimated times for the exhaust gas to arrive at the respective exhaust sensor.

FIG. 17 is a table showing firing order and estimated times for the exhaust gas to arrive at the mixing zone.

DETAILED DESCRIPTION

Figure 2:
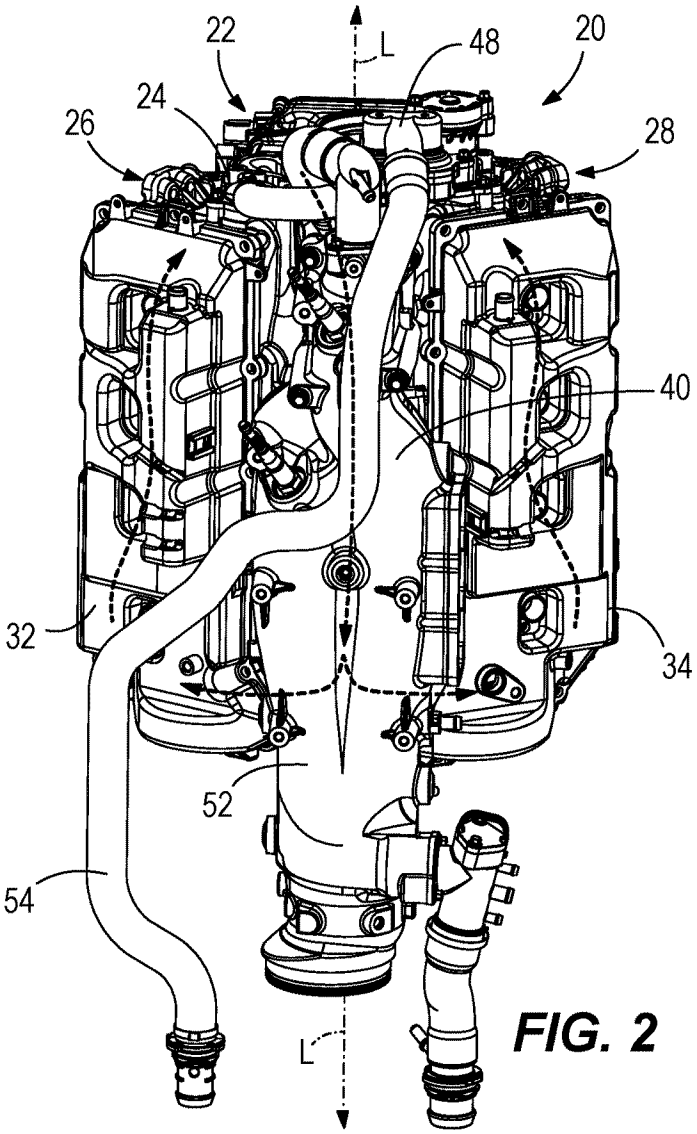
FIG. 2 is a view like FIG. 1, showing flow of cooling fluid from the cooling passage into cooling passages in the cylinder head.

FIGS. 1-3 and 5-6 depict portions of a powerhead 20 for an outboard motor configured to propel a marine vessel in water. Although the powerhead 20 has a generally vertical orientation and is configured for use in an outboard motor, the concepts of the present disclosure are applicable to other types of marine drives, such as for example inboard drives, stern drives, and/or the like. The powerhead 20 includes an internal combustion engine 22 having a cylinder block 24 with port and starboard banks of cylinders 26, 28 (see FIG. 6) that are aligned with respect to each other along a longitudinal axis L. The port and starboard banks of cylinders 26, 28 extend transversely relative to each other in a V-shape so as to define a valley V there between. Port and starboard cylinder heads 32, 34 are mounted to the port and starboard banks of cylinders 26, 28, all as is conventional.

Figure 6:
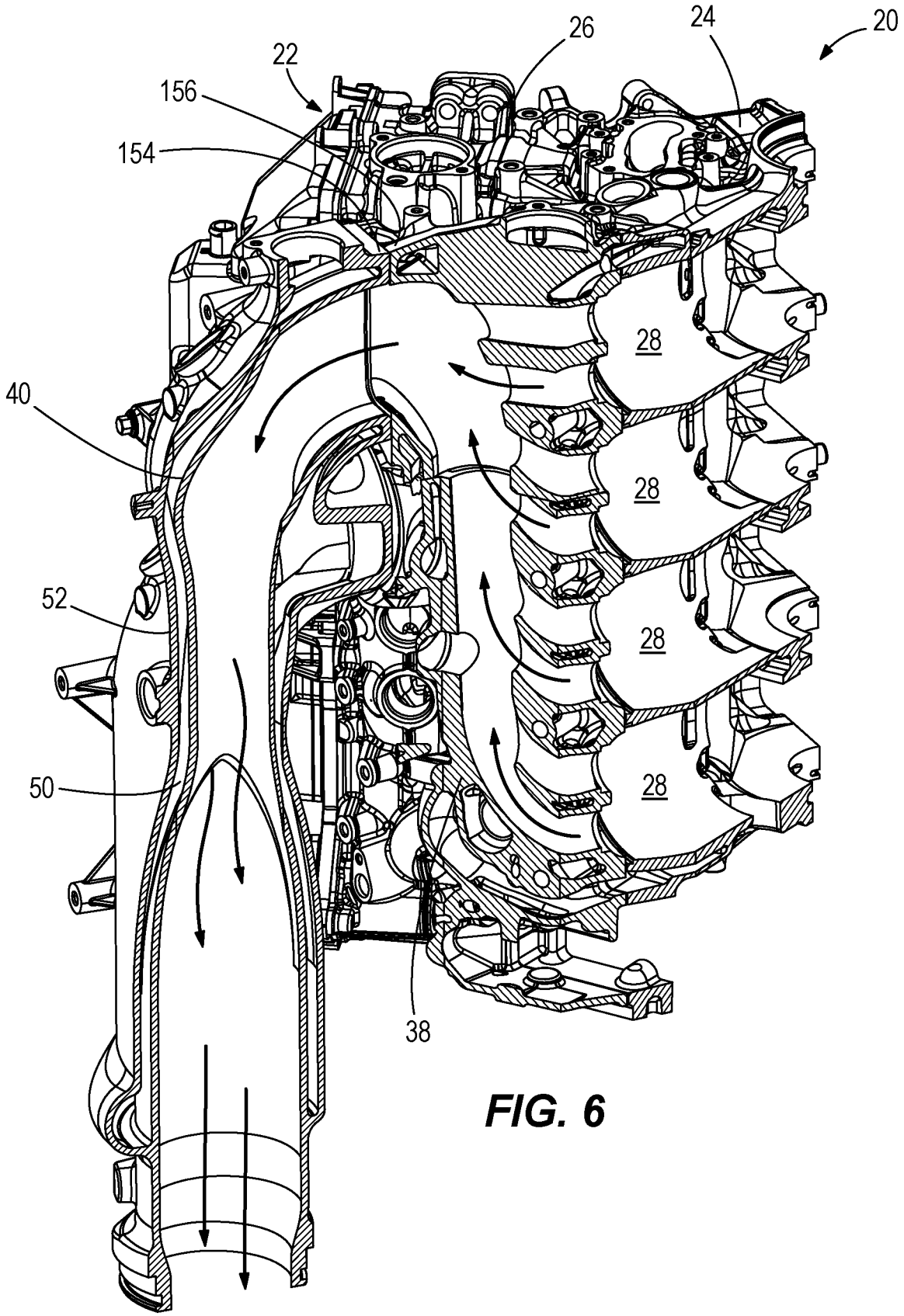
FIG. 6 is a sectional view showing flow of exhaust gas through the exhaust manifold.

Referring to FIG. 6, the powerhead 20 further includes port and starboard exhaust logs 36, 38 (only the starboard exhaust log 38 is shown) into which exhaust gases from the first and second banks of cylinders 26, 28 are collected and conveyed upwardly and downwardly relative to the longitudinal axis L. An exhaust manifold 40 is located in the valley V and, as further explained herein below is configured to merge and convey the exhaust gases from the port and starboard exhaust logs 36, 38 downwardly relative to the longitudinal axis L for discharge from the outboard motor. This type of arrangement is disclosed in the above-incorporated U.S. Pat. No. 9,616,987. It should be noted that concepts of the present disclosure are not limited for use with the illustrated powerhead 20, and can for example be used with other arrangements having different configurations of the internal combustion engine 22.

Referring to FIGS. 1-3 and 4, a cooling system 42 (see FIG. 4) is configured to convey cooling fluid through the powerhead 20 to thereby exchange heat with and thus cool various components of the powerhead 20. The cooling system 42 is an open loop circuit that conveys cooling water from the body of water 44 in which the outboard motor is operated to the powerhead 20 and then back to the body of water 44. In the illustrated example, the cooling system 42 has a cooling water pump 46 that pumps the cooling water from the body of water 44, generally through the powerhead 20 and then back to the body of water 44. A conventional thermostat valve 48 controls discharge of the cooling water back to the body of water 44. This type of cooling system arrangement is conventional, examples of which are disclosed in the above-incorporated U.S. Pat. Nos. 7,398,745; 10,233,818; and 10,378,423, among others. The type and configuration of cooling system 42 can vary from what is shown. In other examples, the cooling system 42 can be a closed loop cooling system configured to pump glycol or any other suitable cooling fluid in a closed loop circuit through the powerhead 20.

Figure 1:
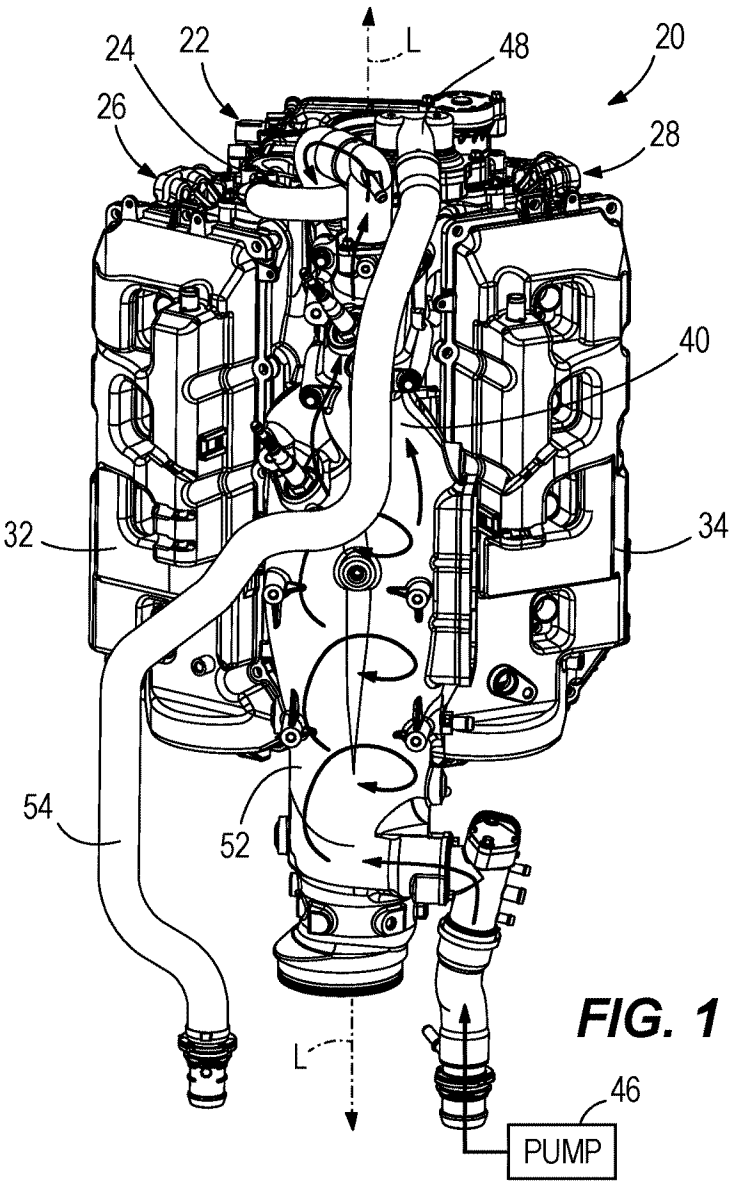
FIG. 1 is a rear view of an exemplary marine drive having a cylinder block, cylinder heads, and an exhaust manifold, particularly showing flow of cooling fluid through a cooling passage on the exhaust manifold.
Figure 3:
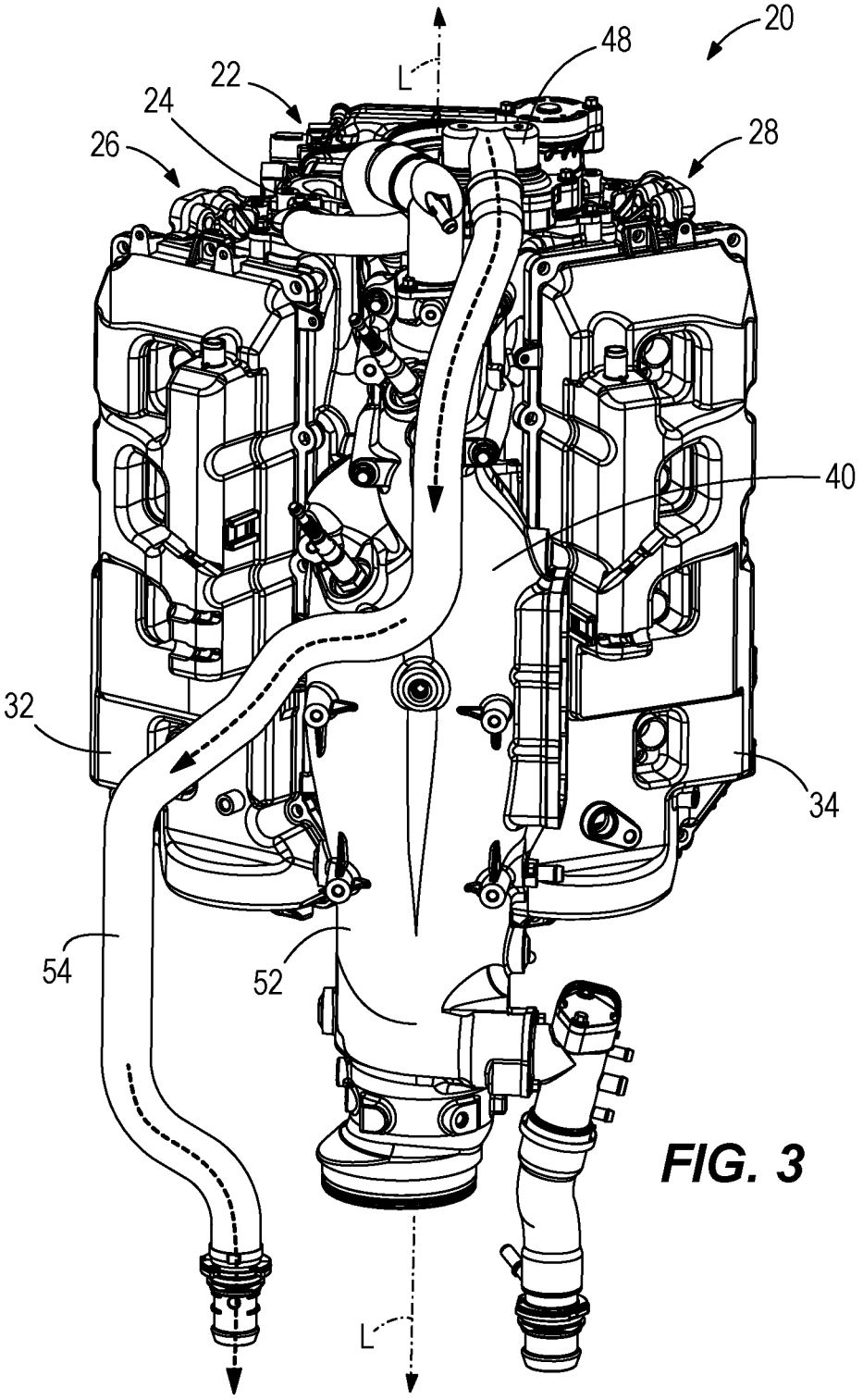
FIG. 3 is a view like FIG. 2, showing flow of cooling fluid from the cooling passages in the cylinder head.

Referring to FIGS. 1 and 6, a cooling passage 50 is defined between the exhaust manifold 40 and a cooling jacket 52 disposed on and surrounding the exhaust manifold 40. The cooling water pump 46 pumps cooling water upwardly though the cooling passage 50 in the circuitous (e.g., helical) path shown by arrows in FIG. 1, and so that the relatively cold cooling water exchanges heat with and thus cools the relatively hot exhaust manifold 40 and the relatively hot exhaust gases therein. This type of arrangement is conventional, examples of which are disclosed in the above-incorporated U.S. Pat. No. 10,378,423, among others.

As shown by dashed line in FIG. 2, the cooling water is then conveyed back downwardly in the valley V through an optional oil cooler (also referred to in the art as a "valley cooler") located in the valley V between the exhaust manifold 40 and the cylinder block 24, and then laterally into passages formed in the cylinder block 24 and cylinder heads 32, 34, so as to exchange heat with and thus cool these components. In the illustrated example, the thermostat valve 48 is mounted on top of the powerhead 20 and configured to automatically open and close based on temperature of the cooling water and thus automatically control discharge of the cooling water from the powerhead 20 via a discharge line 54, all as is conventional. See the dashed line in FIG. 3.

Figure 4:
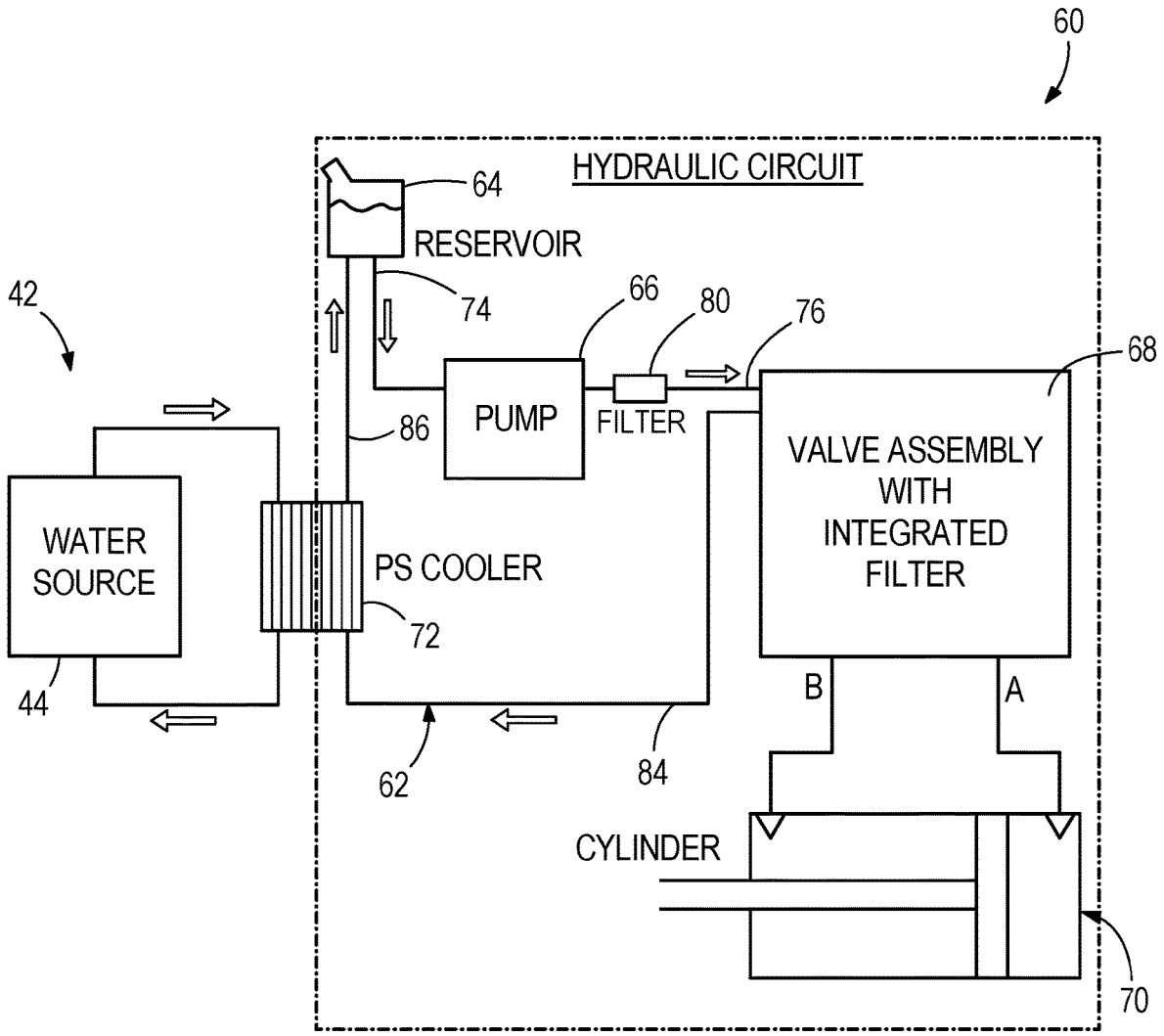
FIG. 4 is a schematic view of a power steering system for steering the marine drive, particularly showing a power steering cooler that is cooled by the cooling fluid in the cooling passage on the exhaust manifold.
Figure 5:
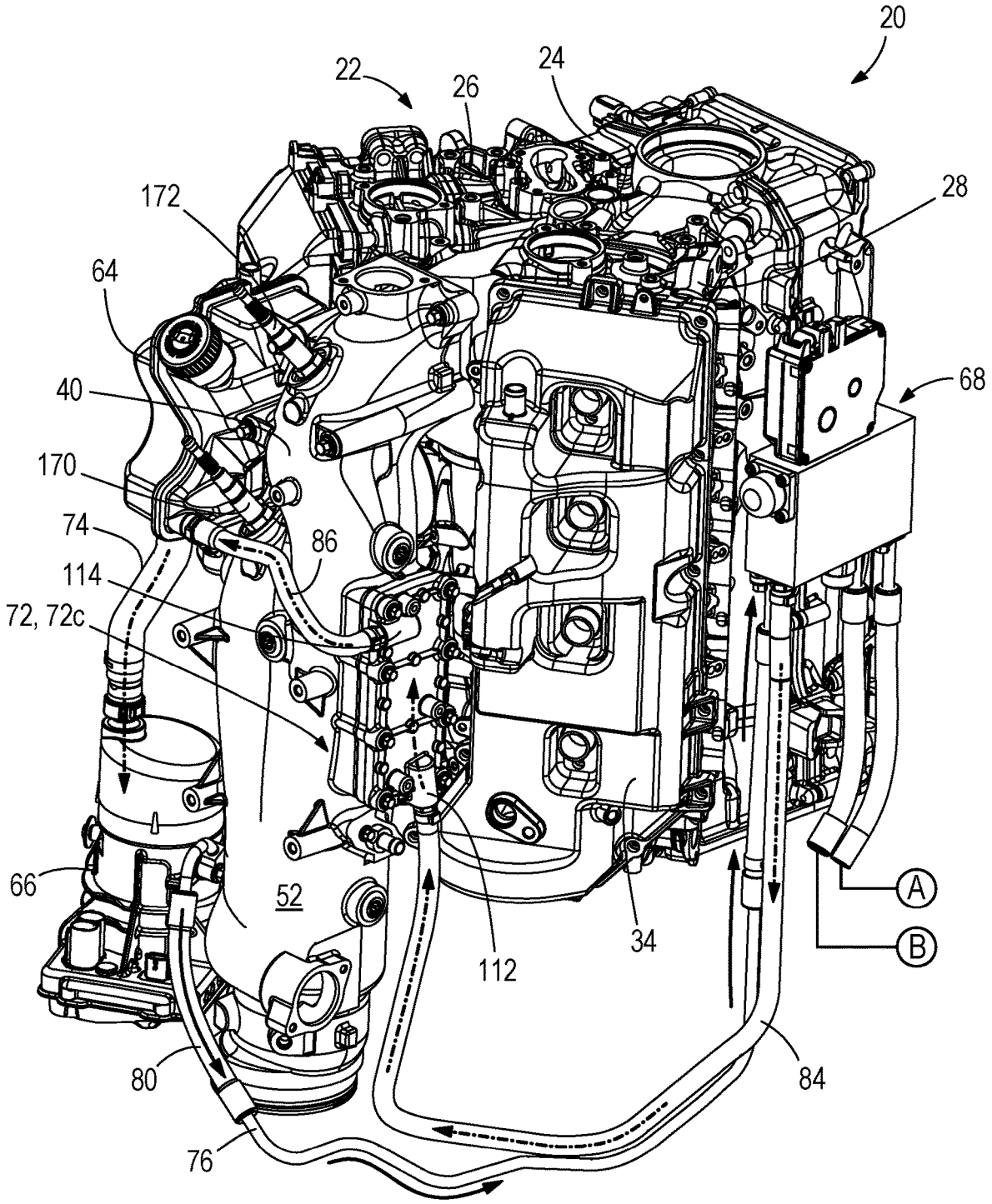

Referring to FIGS. 4-5, a power steering system 60 facilitates power (i.e., automatic) steering of the outboard motor relative to the marine vessel. The power steering system 60 includes a power steering circuit 62 having passages and/or conduits and/or fluid conveyance lines that convey a power steering fluid (i.e. hydraulic fluid, oil) from upstream to downstream, including from a power steering reservoir 64 to a power steering pump 66, from the power steering pump 66 to a conventional power steering control valve 68, from the power steering control valve 68 to a conventional power steering actuator 70, also from the power steering control valve 68 to a novel power steering cooler 72 which is further described herein below, and then from the power steering cooler 72 back to the power steering reservoir 64. The type and configuration of the power steering system 60 can vary from what is shown.

Referring to FIG. 5, the power steering reservoir 64 is mounted on the port side of the powerhead 20 and is configured in the manner disclosed in the above-incorporated U.S. Pat. No. 10,472,038. A suitable example is commercially available from Mercury Marine model no. 8M0152621. An outlet conduit 74 is coupled to the power steering reservoir 64. The power steering pump 66 pumps the power steering fluid from power steering reservoir 64 via the outlet conduit 74. The power steering pump 66 can be any conventional hydraulic pump that is suitable for supplying power steering fluid (e.g. oil) under pressure to a power steering control valve 68, for example available for sale from Mercury Marine, model no. 8M6006764. The power steering pump 66 pumps the power steering fluid through a conduit 76, which conveys the power steering fluid to the power steering control valve 68, which is configured to actuate the power steering actuator 70. The power steering actuator 70 can be a conventional piston and cylinder assembly configured to steer the outboard motor relative to the marine vessel. The type and configuration of the power steering control valve 68 and power steering actuator 70 can vary, and suitable examples are commercially available from Mercury Marine, model no. 8M6007771. Additional suitable examples are also disclosed in the above-incorporated U.S. Pat. Nos. 6,402,577; 9,290,256; and 9,849,957. In one type of arrangement, the power steering control valve 68 is operable to control flow of the steering fluid to opposite sides (A, B) of the noted piston and cylinder assembly to control movement of the piston and rod within the cylinder, thereby actuating a steering arm on the outboard motor, all as is conventional.

Through research and experimentation, the present inventors have determined that the power steering fluid heats up during operation and needs to be cooled down. The power steering fluid also needs to be filtered so as to protect components such as the power steering control valve from debris. The inventors have also realized that space on the outboard motor, especially under the top cowl, is limited. The present disclosure is a result of the inventors' efforts to overcome these challenges.

As shown in FIG. 4, a filter 80 is connected to the outlet conduit 76 and is configured to filter particulates from the power steering fluid. The filter 80 is advantageously located between the power steering pump 66 and the power steering control valve 68 so as to capture particulates that are shed from the power steering pump 66, thus protecting the power steering control valve 68 from damage. The type and configuration of the filter 80 can vary.

As shown in FIG. 4, the power steering control valve 68 is also configured to circulate the power steering fluid back to the power steering reservoir 64 via the novel power steering cooler 72, which advantageously utilizes cooling water from the above described cooling system 42, and more particularly the cooling water in the cooling passage 50 on the exhaust manifold 40, to cool the power steering fluid. In particular, the power steering control valve 68 supplies relatively warm power steering fluid to the power steering cooler 72 via a conduit 84 and the power steering cooler 72 circulates cooled power steering fluid back to the power steering reservoir 64 via a conduit 86. The power steering cooler 72 is advantageously configured to receive cooling water from the cooling system 42, which as explained herein above circulates cooling water from and back to the body of water 44.

The configuration of the power steering cooler 72 can vary, and several preferred examples are depicted in FIGS. 7-13. In general, the power steering cooler 72 is advantageously configured such that the power steering fluid is cooled by the cooling water in the cooling passage 50 defined between the cooling jacket 52 on the exhaust manifold 40. As explained herein below, this is a particularly efficient arrangement that saves space and can be economically manufactured.

Figure 7:
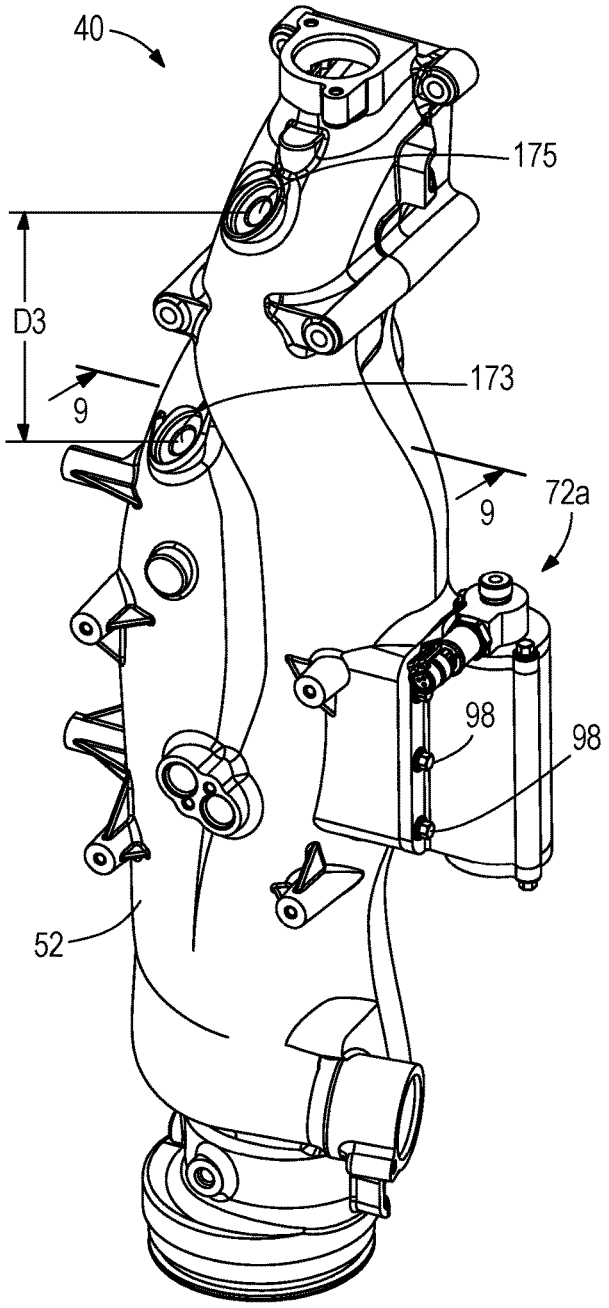
FIG. 7 is front view of the exhaust manifold.
Figure 8:
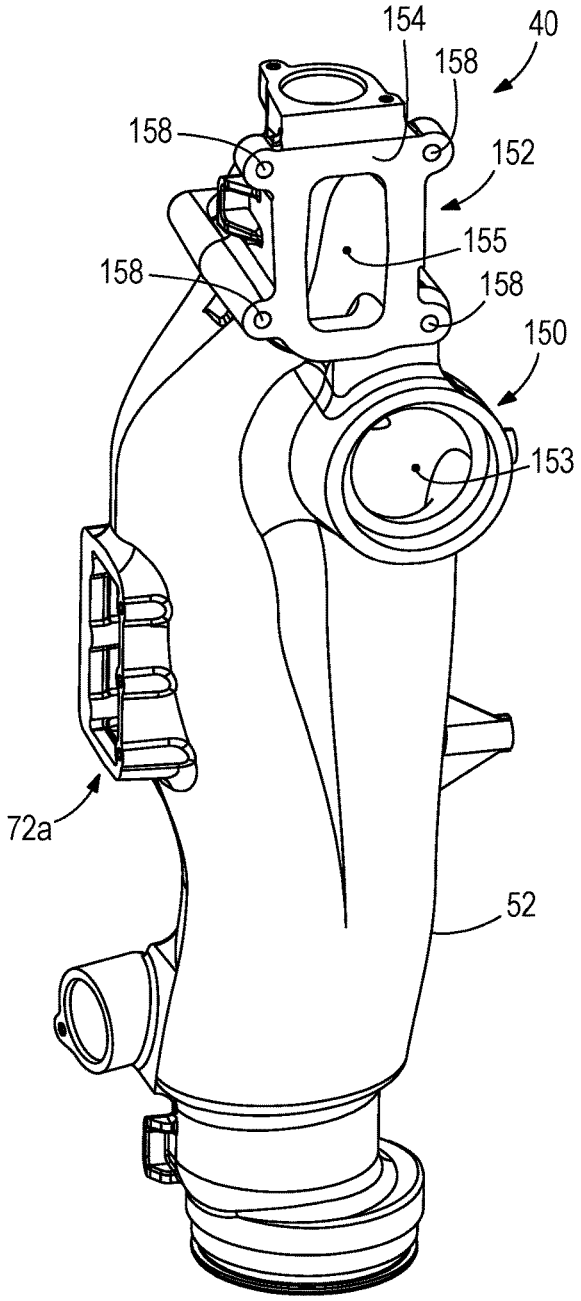
FIG. 8 is a rear view of the exhaust manifold.
Figure 10:
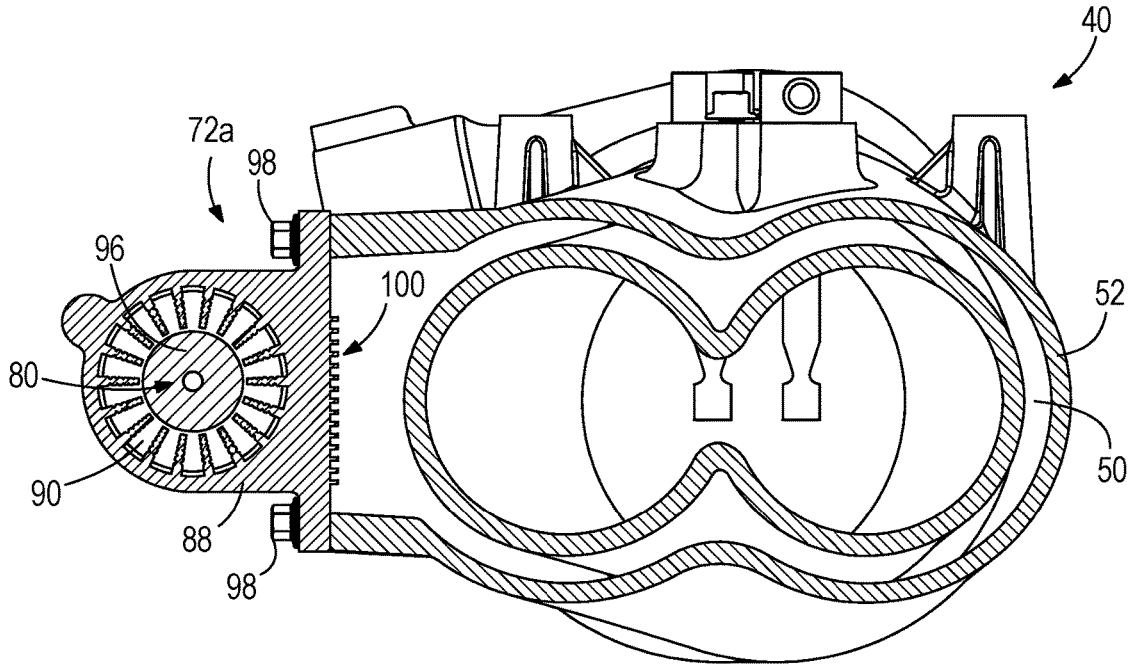
FIG. 10 is sectional view through the exhaust manifold and a first example of the power steering cooler.

FIGS. 7, 8 and 10 depict a first example of the power steering cooler 72*a*. The power steering cooler 72*a* has a body 88 mounted on the cooling jacket 52 and enclosing the cooling passage 50 with respect to the exhaust manifold 40. The body 88 can for example be made of a material that is the same as the exhaust manifold 40, for example aluminum. The body 88 defines a passage 90 that extends longitudinally through the body 88 and alongside the exhaust manifold 40, and is particularly configured to convey the power steering fluid from the conduit 84 to the conduit 86, alongside cooling passage 50 and so as to permit an exchange of heat with the relatively cold cooling water therein. In particular, the relatively cold cooling water in the cooling passage 50 cools the body 88, which in turn cools the relatively warm power steering fluid in the passage 90. In this example, the body 88 also contains the filter 80 which is configured to filter (remove) particulate material from the power steering fluid. Thus for this example, the layout of FIG. 4 would be modified to locate the filter 80 with the power steering cooler 72. The body 88 thus constitutes a filter housing and a filter media 96 is disposed in the filter housing. The filter media 96 can be a conventional filter media for filtering the power steering fluid. The body 88 is bolted onto the cooling jacket 52 via fasteners 98. Optionally, fins 100 extend from an interior surface of the body 88, laterally into the cooling passage 50. The fins 100 provide more surface area for contact of the respective cooling fluid as compared to a flat surface, thus facilitating/promoting better heat exchange between the relatively warm body 88 and the relatively cold cooling water in the cooling passage 50.

Figure 11:
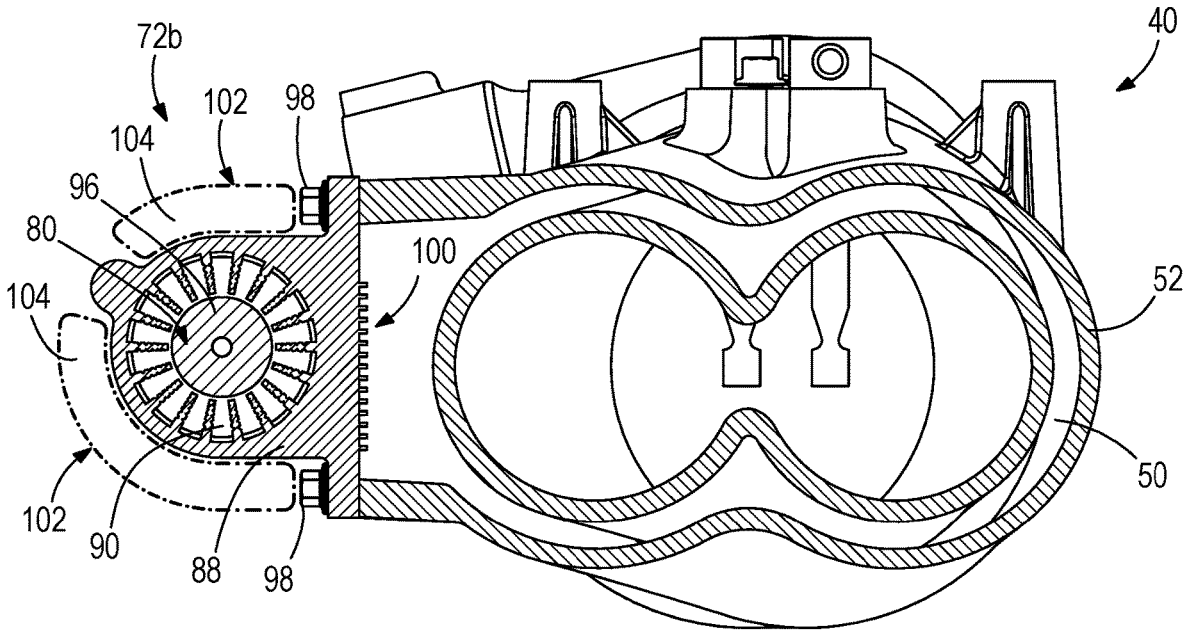
FIG. 11 is a sectional view through the exhaust manifold and a second example of the power steering cooler.

FIG. 11 depicts a second example of a power steering cooler 72*b*, which is like the first example; however the power steering cooler 72*b* has an additional cooling jacket 102 on the opposite side of the body 88 relative to the cooling jacket 52. The cooling jacket 102 defines additional passageways 104 shown in dashed-and-dot line for longitudinally conveying cooling fluid in parallel to the cooling fluid in the cooling passage 50, thus providing additional cooling of the body 88 and the power steering fluid therein. The configuration of the additional cooling jacket 102 and passageways 104 can vary from what is shown.

Figure 12:
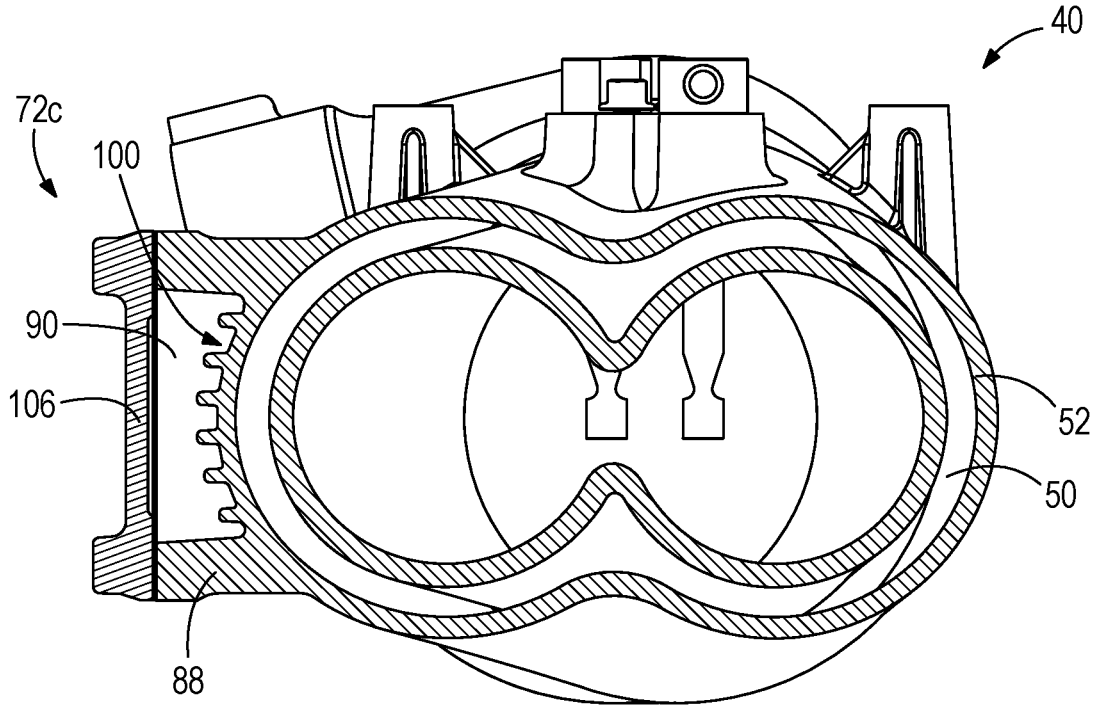
FIG. 12 is a sectional view through the exhaust manifold and a third example of the power steering cooler.

FIG. 12 depicts a third example of the power steering cooler 72*c*, which as compared to the first example does not include the filter housing. Instead, the power steering cooler 72*c* has a body 88 that is integrally formed (e.g., cast) with the cooling jacket 52 and a cap 106 mounted on the body 88 by fasteners 98. The body 88 and cap 106 together define a passage 90 that extends alongside the exhaust manifold 40 between the cap 106 and cooling jacket 52. This example includes fins 100 that extend from the outer surface of the cooling jacket 52 into the passage 90, thus facilitating/promoting heat exchange between the relatively warm body 88 and the relatively cold cooling water in the cooling passage 50. This also will provide less obstruction to flow of cooling water as compared to the examples shown in FIGS. 10-11. In this example, the layout of FIG. 4 would be as-shown, or optionally the filter 80 could be integrated with the valve assembly 68.

Figure 13:
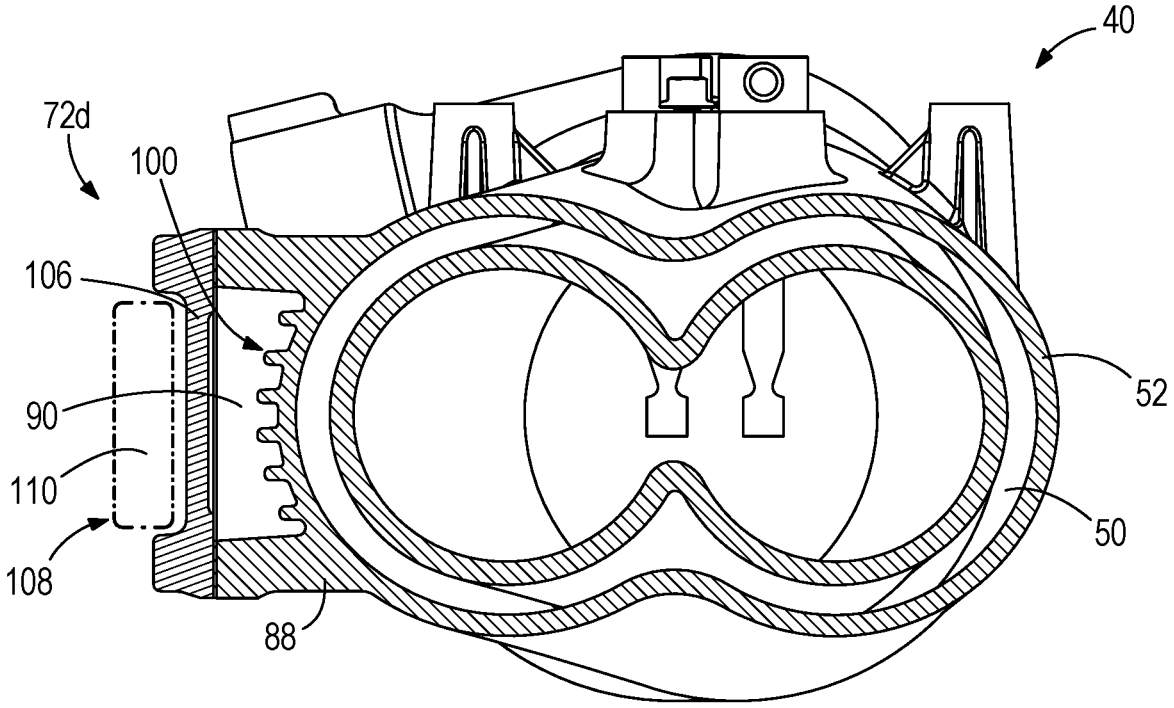
FIG. 13 is a sectional view through the exhaust manifold and a fourth example of the power steering cooler.

FIG. 13 depicts a fourth example of the power steering cooler 72*d*, which is like the third example except it has an additional cooling jacket 108 on the opposite side of the cap 106 relative to the cooling jacket 52. The cooling jacket 108 defines an additional passageway 110 shown in dashed-and-dot line for longitudinally conveying cooling fluid in parallel to the cooling fluid in the cooling passage 50, thus providing additional cooling of the cap 106. The configuration of the additional passageway 110 can vary from what is shown. Optionally, like the third example, the power steering cooler 72*d* has fins 100 that extend from outer surface of the cooling jacket 52 into the cooling passage 50.

FIG. 5 includes arrows depicting flow of the power steering fluid through the power steering system 60. FIG. 5 also shows the location of components of the power steering system 60 with respect to the powerhead 20. The power steering reservoir 64 is mounted on the aftward side of the powerhead 20, along the upper port side of the exhaust manifold 40, and is configured in the manner disclosed in the above-incorporated U.S. Pat. No. 10,472,038. The power steering reservoir 64 has a downwardly-oriented outlet, which discharges the power steering fluid via the conduit 74, downwardly along the port side of the exhaust manifold 40 to an upwardly-oriented inlet on the power steering pump 66. The power steering pump 66 has an outlet that discharges the power steering fluid via conduit 76 to downwardly-oriented inlet on the power steering control valve 68, which is mounted on the upper starboard side of the cylinder block 24. This constitutes the above-noted high pressure side of the power steering system 60.

The power steering control valve 68 has downwardly-oriented outlet ports A, B, which as described above supply power steering fluid to opposing sides of the power steering actuator 70 (shown in FIG. 4). The power steering control valve 68 also has a downwardly-oriented outlet for discharging the power steering fluid to conduit 84, which conveys the power steering fluid to a downwardly oriented inlet 112 on the lower end of the power steering cooler 72*c*. The power steering fluid is conveyed upwardly alongside the cooling jacket 52, as described herein above with reference to FIGS. 10-13, to an aftwardly-oriented outlet 114. The conduit 86 conveys the relatively cold steering fluid from the outlet 114 to an inlet on the power steering reservoir 64. This constitutes the above-noted low pressure side of the power steering system 60.

FIG. 5 depicts the third example of the power steering cooler 72*c* mounted about halfway up alongside the starboard side of the exhaust manifold 40; however it should be understood that any of the other examples could instead be employed and the location of the power steering cooler 72 alongside the exhaust manifold 40 can vary from what is shown. The power steering cooler 72 can be mounted at a location that is easily accessible within the powerhead compartment of the outboard motor by opening of a top cowling, or it could be mounted at a location that is beneath the powerhead compartment.

In the example of FIG. 4, the filter 80 is located on the high pressure side of the power steering circuit 62 and the power steering cooler 72 is located on the low pressure side of the power steering circuit 62, however these locations could be different.

The present disclosure thus provides novel cooling systems for cooling a marine engine and novel power steering systems for steering a marine drive with respect to a marine vessel, including novel power steering coolers, and including but not limited to examples having a filter for filtering power steering fluid and examples without a filter. These novel combinations efficiently utilize the cooling water from alongside the exhaust conduit before it flows into the powerhead by integration of the power steering cooler into the cooling jacket on the exhaust manifold. Optionally, the above-described filter can be packaged into the integrated cooler, thereby avoiding the need for an independent housing and filter lines which otherwise would be required with the filter 80 shown in FIG. 4. This advantageously provides a compact package that performs multiple functions as an exhaust cooler, steering fluid cooler, and filter housing. The inventors also found that the arrangement surprisingly minimalizes condensation due to warming of cooling water flowing to the powerhead. This provides an unexpected performance advantage over the prior art.

Through further research and development, the present inventors endeavored to provide a marine drive having an internal combustion engine that achieves lean-burn with a minimal number of exhaust (oxygen) sensors. The inventors further sought to package a single catalyst in such an arrangement. With reference to the above-incorporated U.S. Pat. No. 9,616,987, the present inventors realized it is possible to provide exhaust ports from the port and starboard cylinder heads that exit at the same height within the V shape; however in such arrangements, the exhaust ports are either in line or above the height of the top cylinders in the V engine. With this type of arrangement, the inventors determined that the exhaust gases from the respective banks of cylinders need to be collected at a single location above or behind the cylinder head. In such an arrangement, the exhaust gases are quickly brought together, and a relatively large area of exhaust manifold was needed to avoid stuffing of the exhaust gases. A bulky and heavy manifold was required, which was difficult to package within the normally minimal allowable design space under a top cowl. The present disclosure is a result of the inventors' realizations of and efforts to overcome these challenges.

Referring to FIGS. 6-9, the exhaust manifold 40 according to the present disclosure has a port-side inlet port 150 (FIG. 8) that receives all of the exhaust gas from the port exhaust log 36 and a starboard-side inlet port 152 that receives all of the exhaust gas from the starboard exhaust log 38. The port-side inlet port 150 and starboard-side inlet port 152 are advantageously offset relative to each other relative to the longitudinal axis L by a nonzero distance D1. More particularly, the centerpoints 153, 155 of the respective port-side inlet port 150 and starboard-side inlet port 152 are spaced apart the nonzero longitudinal distance D1. As explained further herein below, the distance D1 can vary and can include any value greater than zero. In some examples, the port-side inlet port 150 and starboard-side inlet port 152 are longitudinally offset, but still overlap each other in at least some extent with respect to the longitudinal axis L. In other examples the port-side inlet port 150 and starboard-side inlet port 152 are completely non-overlapping in the longitudinal axis L, as shown in the present FIGS. 6-9. In addition, the respective port-side inlet port 150 and starboard-side inlet port 152 are shown overlapping each other in a transverse direction T that is perpendicular to the longitudinal direction L. In the illustrated example, the respective port-side inlet port 150 and starboard-side inlet port 152 are overlapping each other by a distance D2. The distance D2 can vary and can include any value greater than zero. Overlapping the respective port-side inlet port 150 and starboard-side inlet port 152 in the transverse direction advantageously provides the exhaust manifold 40 with a smaller package size and allows for the passages of the exhaust manifold 40 to be longer, through which the exhaust gases can flow prior to being merged. This further advantageously allows for more reliable sensing of exhaust gas characteristics relative to both of the port-side and starboard-side inlet ports 150, 152. However it should be mentioned that the respective port-side inlet port 150 and starboard-side inlet port 152 do not have to overlap each other in the transverse direction T. In other examples, the respective port-side inlet port 150 and starboard-side inlet port 152 are not overlapping each other at all.

Figure 9:
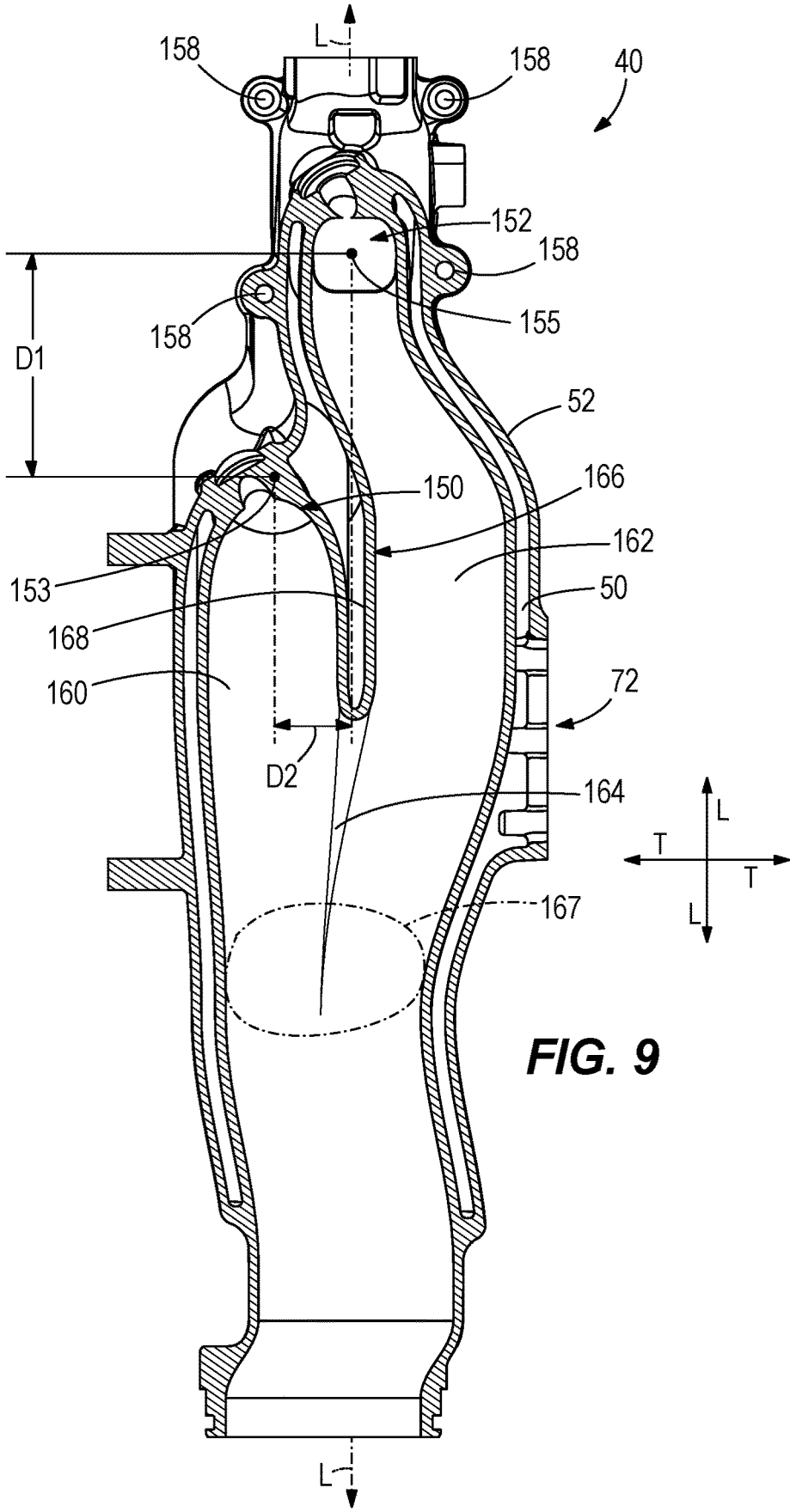
FIG. 9 is a view of section 9-9, taken in FIG. 7.

As best seen in FIGS. 6-8, the port-side and starboard-side inlet ports 150, 152 extend transversely relative to the longitudinal axis L (i.e. into the page in FIG. 9). As such, the exhaust gases flow transversely relative to the longitudinal axis L, outwardly relative to the V-shape before being conveyed downwardly in the V-shape, parallel to the longitudinal axis L. In this example, the starboard-side inlet port 152 is defined by a rigid joint via an inwardly facing mounting flanges 154 on the exhaust manifold 40, which is mounted to a corresponding outwardly facing mounting flange 156 on the starboard exhaust log 38, via for example fasteners extending through mounting holes 158 that radially extend from the mounting flange 154. The port-side inlet port 150 is defined by a so-called flexible or "floating joint" provided by a male-female interference fit between the exhaust manifold 40 and exhaust log 40. This combination allows for variance in size, shape and location of the respective mating features, which inherently occurs during conventional manufacturing processes. The type and configuration of the mounting configurations can vary from that which is shown.

Referring to FIG. 9, the exhaust manifold 40 has a longitudinally-extending port-side inlet passage 160 that conveys the exhaust gas from the port-side inlet port 150. The exhaust manifold 40 also has a longitudinally-extending starboard-side inlet passage 162 that conveys the exhaust gas from the starboard-side inlet port 152. The port-side inlet passage 160 extends from the port-side inlet port 150 to a juncture 164 located at the union point of the radially inner sidewalls of the respective port-side and starboard-side inlet passages 160, 162. As can be seen in FIG. 9, the starboard-side inlet passage 162 is longer than the port-side inlet passage 160 with respect to the longitudinal axis L. This is not intended to be limiting, and in other examples the port-side inlet passage 160 is longer than the starboard-side inlet passage 162. In the illustrated example, the starboard-side inlet passage 162 longitudinally extends from the starboard-side inlet port 152 to the juncture 164, at which point the exhaust gas from the port-side inlet passage 160 is merged with the exhaust gas from the starboard-side inlet passage 162 as it is conveyed through a common exhaust conduit portion located downstream of the port-side and starboard-side inlet passages 160, 162. This is generally referred to herein below as a "mixing zone" 167 for the exhaust gases, which is shown via dashed lines in FIG. 9. Optionally, a catalyst (not shown) can be installed into the common exhaust conduit portion 165.

Referring to FIG. 9, a septum 166 is located between the port-side and starboard-side inlet passages 160, 162 and together with the cooling jacket 52 defines a longitudinally-elongated cooling fluid passage 168, which conveys cooling water in the cooling passage 50 between the port-side and starboard-side inlet passages 160, 162, thus advantageously promoting cooling of the exhaust gases flowing there through.

Referring to FIGS. 5 and 7-9, a port-side exhaust sensor 170 (FIG. 5) is coupled to and extends into the exhaust manifold 40 along the port-side inlet passage 160, upstream of the juncture 164, and is configured to sense a characteristic, (e.g., oxygen content), of the exhaust gas conveyed through the port-side inlet passage 160. The port-side exhaust sensor 170 extends through a mounting boss 173 (FIG. 7) on the cooling jacket 52 along the port-side inlet passage 160. A starboard-side exhaust sensor 172 is coupled to and extends into the exhaust manifold 40 along the starboard-side inlet passage 162, upstream of the juncture 164, and is configured to sense a characteristic (e.g. oxygen content) of the exhaust gas conveyed through the starboard-side inlet passage 162. The starboard-side exhaust sensor 172 extends through a mounting boss 175 on the cooling jacket 52 alongside the starboard-side inlet passage 162. The type and configuration of the exhaust sensors can vary and is conventional, suitable examples being sold by Mercury Marine part nos. 8M6005747. The sensors are configured to communicate with an engine control unit (ECU) for controlling operation of the internal combustion engine 22, all as is conventional.

Referring to FIG. 7, the port-side exhaust sensor 170 and starboard-side exhaust sensor 172 are spaced apart from each other by a longitudinal distance D3. Referring to FIGS. 7 and 9, the cooling fluid passage 168 defined by the septum 166 is located longitudinally between the port-side and starboard-side exhaust sensors 170, 172, which thus cools this area and advantageously limits cross-talk between the port-side and starboard-side exhaust sensors 170, 172, i.e. so that the values sensed by the port-side exhaust sensor 170 are more reliably based on the exhaust gases in the port-side inlet passage 160 and so that the values sensed by the starboard-side exhaust sensor 172 are more reliably based on the exhaust gases in the starboard-side inlet passage 162.

Referring to FIG. 9, the port-side and starboard-side inlet ports 150, 152 of the exhaust manifold 40 are advantageously longitudinally offset the distance (e.g., D1) necessary to stagger inflow of exhaust gases into the first and second exhaust ports to avoid exhaust gas stuffing in the exhaust manifold 40, and to enable predictable readings by the port-side and starboard-side exhaust sensors 170, 172. The distance D1 can be chosen by the designer of the marine drive based on the firing order of the respective cylinders in the port and starboard banks of cylinders 26, 28. More specifically, the distance D1 can be purposefully selected so that the exhaust gas pulses from each piston and cylinder combination arrives in the manifold 40 and at the port-side and starboard-side exhaust sensors 170, 172 at a different time, respectively, thus preventing stuffing of the exhaust gases and also so as to allow the port-side and starboard-side exhaust sensors 170, 172 to more clearly monitor the exhaust gas emitted by each respective cylinder. Examples of this method is further described herein below with reference to FIGS. 14-15.

Figures 14, 15:
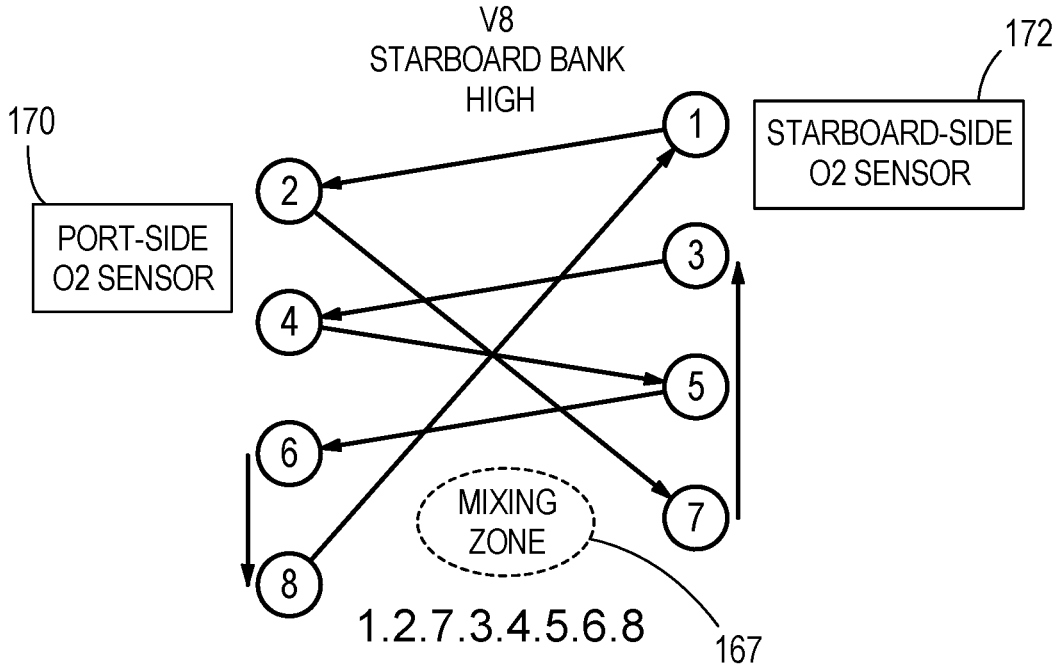
FIG. 14 illustrates an exemplary firing order of cylinders in the powerhead and locations of exhaust sensors and a mixing zone in the exhaust manifold relative to the cylinders.
FIG. 15 is a table showing estimated distances for the exhaust gas to travel to a respective exhaust sensor and to the mixing zone.

FIG. 14 schematically depicts an example firing order for an 8-cylinder marine engine, particularly having cylinders 1-8 with a firing order of 1-2-7-3-4-5-6-8. FIG. 14 also schematically shows the location of the port-side and starboard-side exhaust sensors 170, 172, as well as the mixing zone 167, particularly when the marine engine is configured with the exhaust manifold 40 described herein above. During research and experimentation, the present inventors have realized that it is possible and in fact advantageous to empirically determine or estimate the relative times at which the exhaust gases from the respective cylinders typically arrive at the port-side and starboard-side exhaust sensors 170, 172 and at the mixing zone 167. This can be empirically determined via conventional bench testing methods. Alternately, with reference to FIGS. 15 and 16, this can be estimated based on the particular configuration of the cylinder block 24 and exhaust manifold 40, including for example the number of cylinders, the firing order, and relative distances of the cylinders from the port-side and starboard-side exhaust sensors 170, 172 and from the mixing zone 167. As explained further herein below, by determining or estimating when the exhaust gases arrive at the port-side and starboard-side exhaust sensors 170, 172 and mixing zone 167, during design and manufacture of the exhaust manifold 40, it is possible to intentionally size the distance D1 between the port-side and starboard-side inlet ports 150, 152 so that the exhaust gases arrive at the port-side and starboard-side exhaust sensors 170, 172 and mixing zone 167 in a staggered (non-overlapping in time) manner (i.e. at different times), which advantageously improves the reliability of the values monitored by the respective port-side and starboard-side exhaust sensors 170, 172 and also advantageously avoids (i.e., limits the potential for or reduces) stuffing of exhaust gases in the exhaust manifold 40.

FIG. 15 is a table that was populated based on a relatively simple "distance-based" estimation of exhaust gas travel from the respective cylinders in the port and starboard banks of cylinders 26, 28 to the respective one of the port-side and starboard-side exhaust sensors 170, 172, and to the mixing zone 167. The left-hand column lists the cylinders in sequence 1-8. The middle column is an estimation of a distance-based increment through which the exhaust gas must travel from each respective cylinder to the respective port-side or starboard-side exhaust sensor 170, 172. The right-hand column is an estimation of the distance-based increment through which the exhaust gas must travel from each respective cylinder to the mixing zone 167. In particular, the exhaust gas from the first cylinder (here, starboard cylinder 1) does not have to travel past any other cylinders (via for example the starboard exhaust log 38) to arrive at the starboard-side exhaust sensor 172. As shown in FIG. 14, the starboard-side exhaust sensor 172 is located proximate to starboard cylinder 1. Thus the middle column of table shows an "incremental distance value" of "0". However as shown in FIG. 14, the exhaust gas from starboard cylinder 1 has to travel a distance of about three cylinder diameters to reach the mixing zone 167, particularly as it is conveyed downwardly through the starboard-side inlet passage 162. Thus the right-hand column of the table shows a corresponding incremental distance value of "3". In the same sense, the exhaust gas from the second cylinder (here, port cylinder 2) has to travel a distance of about one cylinder diameter to arrive at the port-side exhaust sensor 172, particularly as it is conveyed downwardly through the port exhaust log 36 to the port-side exhaust port 150. This is because the port-side exhaust sensor 170 is located proximate to the port cylinder 4. Thus the table shows a corresponding incremental distance value of "1". The exhaust gas has to travel about three cylinder diameters to arrive at the mixing zone 167, particularly as it is conveyed downwardly through the port exhaust log 36 and in the port-side inlet passage 160. Thus the table shows a corresponding incremental distance value of "3". This same analysis is equally applied for each of the cylinders 1-8, resulting in the values shown in the table.

FIG. 16 correlates the incremental distance values in the middle column of FIG. 15 to an incremental time-based estimation of when the exhaust gases arrive at the port-side and starboard-side exhaust sensors 170, 172, particularly accounting for the incremental firing order 1-2-7-3-4-5-6-8. The eight cylinders and the firing order are shown in the two left-hand columns, respectively. The far right column lists which of the port-side and starboard-side exhaust sensors 170, 172 sense the exhaust gases from each cylinder. The third column from the left shows the estimated time-based increment at which the exhaust gas reaches the port-side or starboard-side exhaust sensor 170, 172. The time-based increment value is additive of the firing order and the incremental distance over which the exhaust gas must travel from the respective cylinder to the respective exhaust sensor. For example, starboard cylinder 1 fires at firing order zero and travels an estimated incremental distance to the starboard-side exhaust sensor 172 of zero. Thus the estimated incremental time value in the third column of FIG. 16 is zero (0+0=0). Similarly, port cylinder 2 fires at firing order 1 and travels an estimated incremental distance of 1. Thus the estimated incremental time value in the third column of FIG. 16 is 2 (1+1=2). Starboard cylinder 7 fires at firing order 2 and travels an estimated incremental distance of 3. Thus the estimated incremental time value is 5 (2+3=5). This same analysis is applied for each of the cylinders 1-8, resulting in the values shown in the table.

FIG. 17 correlates the incremental distance values in the right-hand column of FIG. 15 to an incremental time-based estimation of when the exhaust gases arrive at the mixing zone 167. The eight cylinders and the firing order are shown in the left-hand and middle columns, respectively. The right-hand column shows the estimated time-based increment at which the exhaust gas reaches the mixing zone 167. For example, starboard cylinder 1 fires at firing order zero and travels an estimated incremental distance to the mixing zone 167 of 3. Thus the estimated incremental time value in the third column of FIG. 17 is 3 (0+3=3). This same analysis is applied for each of the cylinders 1-8, resulting in the values shown in the table.

It should be mentioned that the values in FIGS. 14-17 are merely exemplary based on the particular cylinder configuration and firing order, which can vary from what is shown.

As mentioned herein above, during research and experimentation, the present inventors realized that it would be desirable to construct the exhaust manifold in such a way so as to avoid the above-described "stuffing" of exhaust gases, which occurs when the exhaust gas from two or more cylinders arrive together in the mixing zone 167 of the exhaust manifold 40. The inventors realized that it is desirable to avoid stuffing in a relatively small design package size because available design space is limited in marine drives, particularly under the cowling of outboard motors. The present inventors further realized that it would be desirable to construct the exhaust manifold 40 and port-side and starboard side exhaust sensors 170, 122 so as to avoid cross-talk and thus provide readings that more reliably relate only to the particular cylinder in the marine engine being sensed. The inventors realized that it would be possible to achieve these objectives by carefully designing the exhaust manifold in a way that causes the exhaust gases from each respective cylinder to arrive at each respective exhaust sensor and at the mixing zone at a separate and distinct time from the exhaust gases of the other cylinders, i.e. in a staggered manner for example so that the time-based increments listed in FIGS. 16 and 17 are different from each other. In particular the inventors determined that this can be achieved by first observing (empirically or based on estimates, as described above) when the exhaust gases travel through the respective portions of the exhaust manifold 40, and then intentionally sizing the distance D1 between the port-side and starboard side inlet ports 150, 152 so the noted exhaust gases arrive at the mixing zone 167 in a staggered fashion over time and also for example intentionally locating the port-side and starboard-side exhaust sensors 170, 172 along the port-side and starboard-side inlet passages 160, 162 so that the noted exhaust gases from cylinders in each respective bank of cylinders arrive at the port-side and starboard-side exhaust sensors 170, 172 in a staggered fashion, over time, and/or intentionally sizing the distance D1 between the port-side and starboard side inlet ports 150, 152 so the noted exhaust gases from the respective cylinders arrive at the respective port-side and starboard-side exhaust gas sensors 170, 172 in a staggered fashion over time.

The present disclosure thus provides a novel method of making an exhaust manifold for a marine engine having first and second banks of cylinders disposed along a longitudinal axis and extending transversely relative to each other in a V-shape. In certain non-limiting examples, the method includes (A) forming the exhaust manifold with a first inlet port for receiving substantially all said exhaust gas from the first exhaust log, a second exhaust port for receiving substantially all said exhaust gas from the second exhaust log, and a mixing zone in which the exhaust gas from the first exhaust log mixes with the exhaust gas from the second exhaust log; (B) forming the first and second inlet ports at a nonzero longitudinal offset distance relative to each other; and (C) selecting the non-zero longitudinal offset distance so that the exhaust gas from the first exhaust log does not simultaneously arrive in the in the mixing zone with the exhaust gas from the second exhaust log, thereby advantageously avoiding stuffing of the exhaust gases in a relatively small package size. The method can further include (D) forming the exhaust manifold with a first inlet passage conveying the exhaust gas from the first inlet port and a second inlet passage conveying exhaust gas from the second inlet port, (E) installing a first exhaust sensor in the first exhaust log, the first exhaust sensor configured to sense a characteristic of the exhaust gas in the first inlet passage, and (F) installing a second exhaust sensor in the second exhaust log, the second exhaust sensor configured to sense a characteristic of the exhaust gas in the second inlet passage. The method can further include (H) forming a cooling passage between the first and second inlet ports, the cooling passage configured to cool the exhaust manifold at a location between the first and second inlet ports.

The present disclosure thus provides another novel method of making an exhaust manifold for a marine engine having first and second banks of cylinders disposed along a longitudinal axis and extending transversely relative to each other in a V-shape. The method includes (A) forming the exhaust manifold with a first inlet port for receiving substantially all said exhaust gas from the first exhaust log, a second exhaust port for receiving substantially all said exhaust gas from the second exhaust log, and a mixing zone in which the exhaust gas from the first exhaust log mixes with the exhaust gas from the second exhaust log; (B) locating the first and second inlet ports at a nonzero longitudinal offset distance relative to each other; (C) forming the exhaust manifold with a first inlet passage conveying the exhaust gas from the first inlet port and a second inlet passage conveying exhaust gas from the second inlet port; (D) installing a first exhaust sensor in the first exhaust log, the first exhaust sensor configured to sense a characteristic of the exhaust gas in the first inlet passage; (E) installing a second exhaust sensor in the second exhaust log, the second exhaust sensor configured to sense a characteristic of the exhaust gas in the second inlet passage; and (F) selecting the nonzero longitudinal offset distance so that the exhaust gas from each cylinder in the respective first and second banks of cylinders does not simultaneously arrive at the first and second exhaust sensors, respectively.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A marine drive for propelling a marine vessel, the marine drive comprising:

an engine;

an exhaust manifold that conveys exhaust gas from the engine;

a cooling jacket on the exhaust manifold, wherein a cooling passage is defined between the cooling jacket and the exhaust manifold;

a cooling water pump configured to pump cooling fluid through the cooling passage so as to cool the exhaust manifold and the exhaust gas;

a power steering actuator configured to steer the marine drive relative to the marine vessel;

a power steering pump configured to pump power steering fluid from a power steering reservoir to the power steering actuator; and a power steering cooler on the exhaust manifold and configured such that the power steering fluid is cooled by the cooling fluid in the cooling passage.

2. The marine drive according to claim 1, wherein the power steering cooler comprises a passageway that extends alongside the cooling jacket.

3. The marine drive according to claim 2, wherein the power steering cooler comprises a cap on the cooling jacket, and wherein the passageway is defined between the cap and the cooling jacket.

4. The marine drive according to claim 3, wherein the power steering cooler comprises an additional cooling jacket that defines an additional cooling passage for conveying cooling fluid in parallel alongside the passageway.

5. The marine drive according to claim 2, further comprising a plurality of fins that extend into the passageway and promote heat exchange between the power steering fluid and the cooling fluid in the cooling passage.

6. The marine drive according to claim 1, wherein the exhaust manifold comprises an exhaust conduit and wherein the cooling jacket surround the exhaust conduit.

7. The marine drive according to claim 1, wherein the power steering cooler comprises a filter that filters the power steering fluid.

8. The marine drive according to claim 7, wherein the filter comprises a filter housing and a filter media disposed in the filter housing, and wherein the filter housing is mounted to the cooling jacket on the exhaust manifold.

9. The marine drive according to claim 8, further comprising a plurality of fins extending from the filter housing into the cooling passage, the plurality of fins facilitating heat exchange between the filter housing and the cooling fluid in the cooling passage.

10. The marine drive according to claim 7, further comprising a cooling jacket on the filter, wherein a cooling passage is defined between the filter and the cooling jacket on the filter, and is configured to convey cooling fluid alongside the filter so as to cool the filter and the power steering fluid.

11. The marine drive according to claim 1, further comprising a power steering circuit that conveys the power steering fluid from upstream to downstream, including from the power steering fluid reservoir to the power steering pump, from the power steering pump to the power steering actuator, from the power steering actuator to the power steering cooler, and from the power steering cooler back to the power steering reservoir.

12. The marine drive according to claim 11, further comprising a filter located in the power steering circuit between the power steering pump and the power steering actuator, the filter configured to filter particulates from the power steering fluid.

13. An outboard motor comprising:

an engine;

an exhaust manifold that conveys exhaust gas from the engine;

a cooling jacket on the exhaust manifold, wherein a cooling passage is defined between the cooling jacket and the exhaust manifold;

a cooling pump that pumps cooling fluid through the cooling passage so as to cool the exhaust manifold and the exhaust gas;

a power steering actuator configured to steer the marine drive relative to the marine vessel;

a power steering pump that pumps power steering fluid from a power steering reservoir to the power steering actuator; and a power steering cooler on the exhaust manifold and configured such that the power steering fluid is cooled by the cooling fluid in the cooling passage.

14. A system for cooling a marine drive, the system comprising:

a cooling pump that pumps cooling fluid through a powerhead of the marine drive;

a cooling passage that conveys the cooling fluid alongside an exhaust manifold that conveys exhaust gases from the powerhead so as to cool the exhaust manifold and the exhaust gases; and a power steering cooler that conveys power steering fluid along an opposite side of the cooling passage so that both the exhaust gases and power steering fluid are simultaneously cooled by the cooling fluid in the cooling passage.

15. The marine drive according to claim 14, wherein the power steering cooler comprises a passageway that extends alongside the cooling jacket.

16. A system for cooling a marine drive, the system comprising:

a cooling pump that pumps cooling fluid through a powerhead of the marine drive;

a cooling passage that conveys the cooling fluid alongside an exhaust manifold that conveys exhaust gases from the powerhead so as to cool the exhaust manifold and the exhaust gases; and a power steering cooler that conveys power steering fluid alongside the exhaust manifold so that the power steering fluid is cooled by the cooling fluid in the cooling passage, wherein the power steering cooler comprises a passageway that extends alongside the cooling jacket, and wherein the power steering cooler comprises a cap on the cooling jacket, wherein the passageway is defined between the cap and the cooling jacket.

17. A system for cooling a marine drive, the system comprising:

a cooling pump that pumps cooling fluid through a powerhead of the marine drive;

a cooling passage that conveys the cooling fluid alongside an exhaust manifold that conveys exhaust gases from the powerhead so as to cool the exhaust manifold and the exhaust gases;

a power steering cooler that conveys power steering fluid alongside the exhaust manifold so that the power steering fluid is cooled by the cooling fluid in the cooling passage, wherein the power steering cooler comprises a passageway that extends alongside the cooling jacket, and a plurality of fins that extend into the passageway and promote heat exchange between the power steering fluid and the cooling fluid in the cooling passage.

18. A system for cooling a marine drive, the system comprising:

a cooling pump that pumps cooling fluid through a powerhead of the marine drive;

a cooling passage that conveys the cooling fluid alongside an exhaust manifold that conveys exhaust gases from the powerhead so as to cool the exhaust manifold and the exhaust gases; and a power steering cooler that conveys power steering fluid alongside the exhaust manifold so that the power steering fluid is cooled by the cooling fluid in the cooling passage, wherein the power steering cooler comprises a filter that filters the power steering fluid.

19. The marine drive according to claim 18, wherein the filter comprises a filter housing and a filter media disposed in the filter housing, wherein the filter housing is mounted to the cooling jacket on the exhaust manifold.

20. The marine drive according to claim 19, further comprising a plurality of fins extending from the filter housing into the cooling passage, the plurality of fins facilitating heat exchange between the filter housing and the cooling fluid in the cooling passage.

* * * * *